United States Patent [19]

Scheinecker et al.

[11] 4,217,997

[45] Aug. 19, 1980

[54] ARRANGEMENT AT A CONTINUOUS CASTING PLANT

[75] Inventors: Alois Scheinecker; Werner Scheurecker, both of Linz; Gerhard Mühlbauer, Steyr, all of Austria

[73] Assignee: Voest-Alpine Aktiengesellschaft, Linz, Austria

[21] Appl. No.: 13,228

[22] Filed: Feb. 21, 1979

[30] Foreign Application Priority Data

Mar. 8, 1978 [AT] Austria ..... 1653/78

[51] Int. Cl.[2] ..... B22D 11/10

[52] U.S. Cl. ..... 222/604; 164/438

[58] Field of Search ..... 164/438, 437, 335, 336, 164/337; 222/604, 166; 414/403, 421, 425; 266/276, 274, 275

[56] References Cited

U.S. PATENT DOCUMENTS 2,650,255 8/1953 Hogel et al. ..... 266/276

2,971,662 2/1961 Dunham ..... 414/421

3,926,346 12/1975 Dub et al. ..... 164/438

FOREIGN PATENT DOCUMENTS 1608061 of 1972 Fed. Rep. of Germany ..... 164/438

*Primary Examiner*—Robert D. Baldwin

*Assistant Examiner*—K. Y. Lin

*Attorney, Agent, or Firm*—Brumbaugh, Graves, Donohue & Raymond

[57] ABSTRACT

An arrangement at a continuous casting plant includes a liftable and lowerable tundish mounted on a movable carrier and a tilting device mounted on a tilting stand for emptying of the tundish. The tilting device includes a tilting beam rotatable about its longitudinal axis and the tundish possesses recesses at its lower side, corresponding to the cross section of the tilting beam. Thus the tundish is lowerable at the tilting stand so its recesses make a positive connection with the tilting beam.

8 Claims, 3 Drawing Figures

1
2
4
6
9
10
14
11
16
II
3
15
8
7

4
5
3
2
1
15
III
6
8
12
11
14
16
10

ARRANGEMENT AT A CONTINUOUS CASTING PLANT

BACKGROUND OF THE INVENTION

The invention relates to an arrangement at a continuous casting plant, comprising a liftable and lowerable tundish mounted on a movable carrier, and a tilting device mounted on a tilting stand for emptying the tundish.

Arrangements of this kind are already known, in which the tundish is mounted on an arm rotatable about a column, or on a car displaceable on rails. When exchanging the tundishes, which is particularly necessary in sequence casting, the tundishes have to be dumped in order to remove slag residues. It is important that the exchange of the tundishes is carried out rapidly and without disturbances; manipulations by hand also to be avoided as far as possible. This stipulation has been met only partly with known plants, since preparation works, such as displacing, loosening of connections, etc., have had to be carried out prior to the tilting of the vessel.

SUMMARY OF THE INVENTION

The invention aims at avoiding these difficulties and has as its object to provide a tilting device at, which, during tilting into the emptying position and back, does not require connections or holding devices at the tundish carrier or at the tundish to be unlatched or fixed, so that the connection between the tilting drive and the tundish is effected automatically and operationally safely.

With an arrangement of the initially-defined kind, this object is achieved according to the invention in that the tilting device comprises a tilting beam which is rotatable about its longitudinal axis and preferably has a polygonal cross section. The tundish, at its lower side, possesses recesses corresponding to the cross section of the tilting beam and the tundish is lowerable at the tilting stand so that its recesses come into positive connection with the tilting beam.

Advantageously, the tilting carrier has a square cross section and, suitably, the recesses at the lower part of the tundish are formed by hook-shaped holding devices, preferably with introductory slopes.

For driving the tilting device, angle levers, which preferably are hydraulically actuated, engage the end portions of the tilting beam.

According to a particularly preferred embodiment, the movable carrier for the tundish is formed by a car displaceable on rails, the longitudinal axis of the tilting beam being arranged parallel to the median axes of the rail.

Suitably, one end of the tundish includes an overflow channel which, after movement the tilting stand, covers the tilting beam.

BRIEF DESCRIPTION OF THE DRAWINGS

An advantageous embodiment of the subject matter of the invention is illustrated in the drawings, wherein.

DESCRIPTION OF AN EXEMPLARY EMBODIMENT

Figure 1:
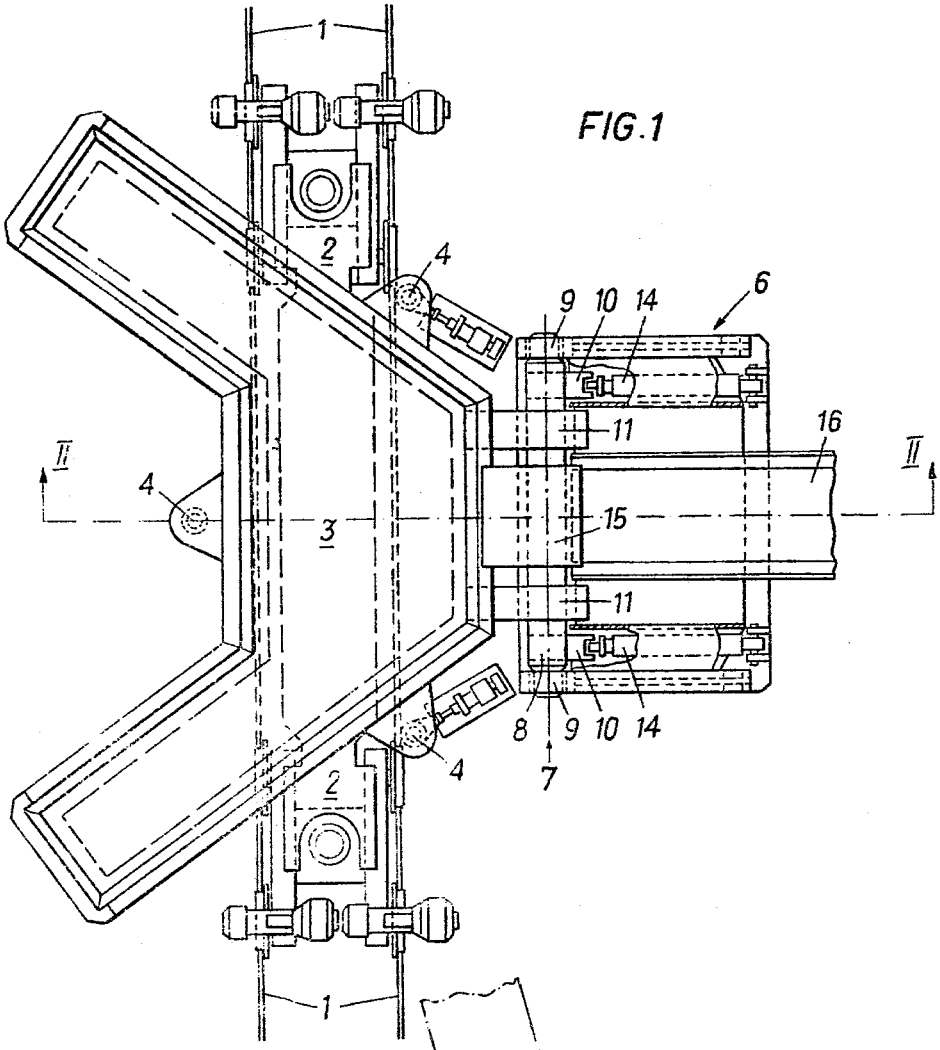
FIG. 1 is a top view of the arrangement according to the invention.
Figure 2:
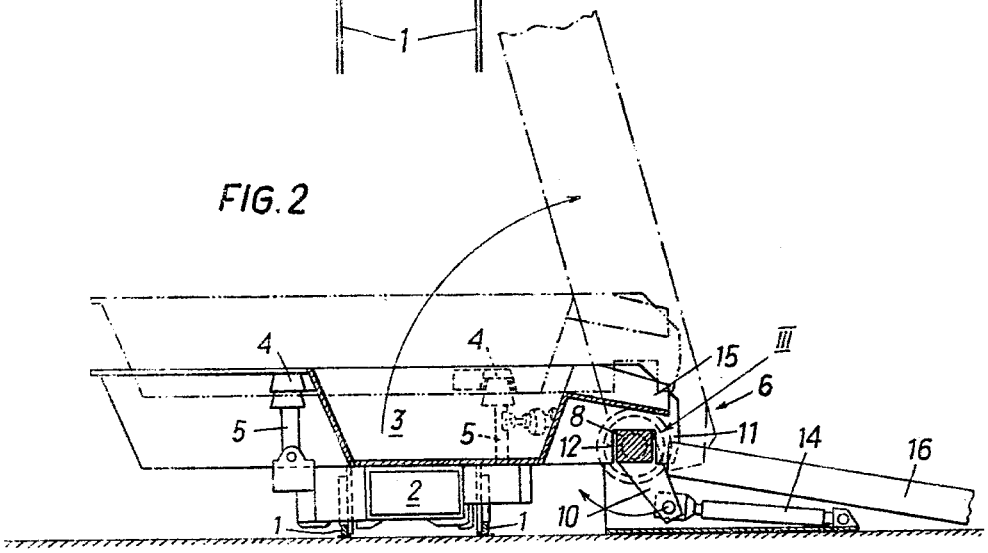
FIG. 2 is a section of the arrangement according to line II—II of FIG. 1.

On rails 1 arranged on the casting platform, a car 2 is displaceable. Mounted on the car is a tundish 3 which is advantageously supported on three supporting points 4 by means of hydraulic cylinders 5 or other lifting means, such that it is liftable and lowerable. In the position illustrated, the car 2 with the tundish 3 has been moved to a tilting stand having a tilting device 6. This tilting device includes a tilting beam 8 rotatable about its longitudinal axis 7 and having a square cross section, which beam extends parallel to the rail median axis and mounted in bearings 9.

Figure 3:
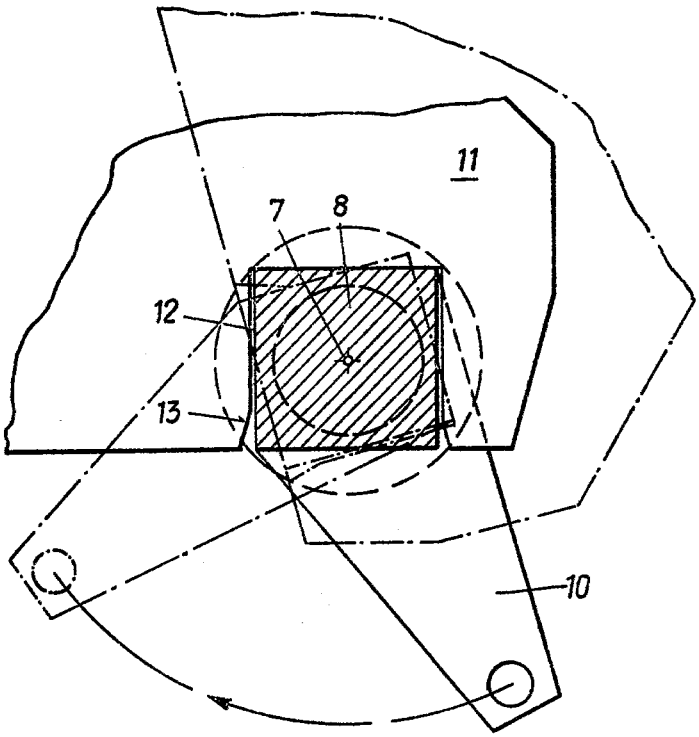
FIG. 3 illustrates a detail according to line III of FIG. 2.

Angle levers 10 engage the ends of beam 8. For connecting the tundish 3 and the tilting beam 8, two spaced-apart holding devices 11 are provided at the lower side of the tundish to create a positive connection. These holding devices include a downwardly open recess 12 that corresponds to the cross section of the beam. Advantageously, the recesses are designed with introductory slopes 13 (FIG. 3). The connection is effected in that the car is brought to the tilting stand with the tundish lifted, and is lowered so that the recesses 12 of the hook-shaped holding devices 11 enbrace the beam 8. For dumping the tundish, the angle levers 10 are actuated by means of hydraulic cylinders 14. On the end of the tundish facing the holding device, there is provided an overflow channel 15 which covers the tilting beam and enters into a casting channel 16.

For reasons of safety the tilting path may be delimited by a stop or the like, so that the center of gravity of the tundish 3 will always remain on the same side of the tilting beam 8 during the tilting procedure, a righting moment thus always being maintained.

We claim:

1. In an arrangement at a continuous casting plant of the type including a movable carrier, a tundish, lifting means for lifting and lowering said tundish, said tundish and lifting means being mounted on said movable carrier, a tilting stand, and a tilting device mounted on said tilting stand for emptying said liftable and lowerable tundish, the improvement which is characterized in that said tilting device includes a tilting beam, said tilting beam being rotatable about its longitudinal axis and having a certain cross section, and said liftable and lowerable tundish, at its lower side, possesses generally downwardly open recesses, said recesses corresponding to said certain cross section of said tilting beam, said liftable and lowerable tundish being lowerable at said tiltable stand so that the recesses come into positive connection with said tilting beam.

2. An arrangement as set forth in claim 1, wherein said certain cross section of said tilting beam is polygon-shaped.

3. An arrangement as set forth in claim 1, wherein said tilting beam has a square cross section, and said tundish further includes hook-shaped holding devices forming said recesses, said holding devices being provided at said lower side of said liftable and lowerable tundish.

4. An arrangement as set forth in claim 3, wherein the recesses of said hook-shaped holding devices have introductory slopes.

5. An arrangement as set forth in claim 1, wherein said tilting beam has end portions, and said arrangement further comprises angle levers engaging said end portions.

6. An arrangement as set forth in claim 5, wherein said angle levers are hydraulically actuated.

7. An arrangement as set forth in claim 1, further comprising rails having a median axis and wherein said movable carrier is formed by a car, said car being movable on said rails and the longitudinal axis of said tilting beam being arranged so as to be parallel to said median axis of said rails.

8. An arrangement as set forth in claim 1, further comprising an overflow channel provided at one end of said liftable and lowerable tundish, said overflow channel covering said tilting beam after movement of said liftable and lowerable tundish to said tilting stand.

* * * * *